US011123623B1

(12) United States Patent
Melachrino

(10) Patent No.: US 11,123,623 B1
(45) Date of Patent: Sep. 21, 2021

(54) FOOTBALL KICK TRAINING APPARATUS, METHOD AND KIT

(71) Applicant: Antonio D. Melachrino, Ormond Beach, FL (US)

(72) Inventor: Antonio D. Melachrino, Ormond Beach, FL (US)

( * ) Notice: Subject to any disclaimer, the term of this patent is extended or adjusted under 35 U.S.C. 154(b) by 0 days.

(21) Appl. No.: 17/301,814

(22) Filed: Apr. 15, 2021

(51) Int. Cl.
*A63B 69/00* (2006.01)
*A63B 63/00* (2006.01)

(52) U.S. Cl.
CPC ..... *A63B 69/002* (2013.01); *A63B 63/00* (2013.01); *A63B 63/008* (2013.01); *A63B 69/0075* (2013.01); *A63B 2210/52* (2013.01); *A63B 2243/007* (2013.01)

(58) Field of Classification Search
CPC . A63B 61/00–04; A63B 63/00; A63B 63/008; A63B 69/002; A63B 2069/0006; A45C 2003/007
See application file for complete search history.

(56) References Cited

U.S. PATENT DOCUMENTS 3,472,511 A * 10/1969 Shirley ..... A63B 69/002 473/419
4,274,632 A * 6/1981 Jacobs ..... A63B 61/02 473/492
4,420,158 A * 12/1983 Klock ..... A63B 63/004 248/156
4,836,542 A * 6/1989 Crawley ..... A63B 63/008 273/400
5,193,802 A 3/1993 Saltus
5,271,616 A 12/1993 Grimaldi
5,513,843 A 5/1996 Russell
5,564,711 A * 10/1996 Scheie ..... A63B 61/00 273/400
5,588,645 A 12/1996 Schwan et al.
5,803,842 A 9/1998 Ross
6,063,005 A 5/2000 Schwartz
(Continued)

OTHER PUBLICATIONS

Kicking World, "Football Kicking Bag", https://www.kickingworld.com/product/football-kicking-bag/, archived by the Internet Archive on Apr. 5, 2016 (Year: 2016).*
(Continued)

*Primary Examiner* — Laura Davison
(74) *Attorney, Agent, or Firm* — Lori Sandman, Esq.

(57) ABSTRACT

The invention disclosed comprises an apparatus, method of using, assembling and stowing the apparatus, and a kit including the apparatus and components for training players to achieve lift when kicking a football that requires an angled trajectory. The invention functions to provide a physical point of reference and visual target for a kicker to establish consistent kicking skills and achieve predictable angles. The apparatus is sturdy, easily and reversibly disassembled, and stored as part of a durable, packable kit to organize the required training gear. The method includes a series of steps whereby the apparatus is assembled; a kicker kicks the ball; if the angle of the kick is sufficient to lift the ball over the apparatus it will go over the visual target, if not it will fall under the visual target. The kit comprises at least a carry bag with various pockets for the device and related equipment.

15 Claims, 6 Drawing Sheets

(56) References Cited

U.S. PATENT DOCUMENTS

| | | | | |
|---|---|---|---|---|
| 6,193,034 | B1 * | 2/2001 | Fournier | A45C 7/0095 190/107 |
| 6,375,584 | B1 | 4/2002 | Shapiro | |
| 6,752,729 | B1 * | 6/2004 | Huang | A63B 63/004 403/91 |
| 6,899,645 | B1 * | 5/2005 | Hsiao | A63B 63/004 273/400 |
| 8,715,116 | B2 * | 5/2014 | Cerasoli | A63B 63/00 473/478 |
| 2014/0135153 | A1 | 5/2014 | Wartenweiler | |
| 2017/0246522 | A1 * | 8/2017 | Donley | A63B 63/004 |

OTHER PUBLICATIONS

Field Goal Kicker Online, "How to Practice Kicking Field Goals", https://www.fieldgoalkicker.com/how-to-practice-kicking-field-goals/, archived by the Internet Archive on Aug. 22, 2016 (Year: 2016).*

Sport Squad, "2-in-1 Dual Use Training Soccer Goal Net", for sale on Amazon.com, https://www.amazon.com/Sport-Squad-Dual-Training-Soccer/dp/B07WHV1JHF?th=1, Date First Available: Mar. 3, 2021 (Year: 2021).*

* cited by examiner

FOOTBALL KICK TRAINING APPARATUS, METHOD AND KIT

CROSS-REFERENCE TO RELATED APPLICATIONS

Not applicable.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND

This invention relates to the field of sports training devices. Specifically, it discloses a novel apparatus, a method of using, assembling and stowing the apparatus, and a kit comprising the apparatus and other components for training kickers to achieve lift when kicking a football or other sporting object requiring an angled trajectory. The apparatus, method and kit functions to train kickers to achieve lift of the ball to a trajectory sufficient to clear defensive players and a goal post or other scoring point. The invention operates as a visual and physical barrier so the kicker can target a minimum height.

BRIEF SUMMARY

Sporting events and on-field training sessions require equipment, often specialized for a particular sport. With kick training, balls, nets, markers and other apparatus and gear can be cumbersome and difficult to organize, stow, transport and set up, particularly if the field or playing area is remote. Also, many training products and their related sporting goods come with individual bags or storage containers, resulting in duplicative efforts to organize, pack and carry a variety of equipment. It would be advantageous to have a kit to organize the various training components a football kicker would require.

Typical kicking training devices rely on a frame with a net to keep the ball in a limited or confined area for easy retrieval. These devices do nothing to provide the kicker with a relevant visual context for targeting the ball or other object being kicked at a required angle. Also, in kicking lift training, it is critical to create an angular field of vision. Typical commercially available devices have straight or round sides that do not provide the angular target. Training using these devices therefore falls short of the desired goal. The invention disclosed herein offers a different approach.

The present invention comprises a novel apparatus, a method of using, assembling and stowing the apparatus, and a kit including the apparatus and other components for training players to achieve lift when kicking a football or other sporting object requiring an angled trajectory. In a preferred embodiment, the optimal angle of trajectory is between 42 and 45 degrees relative to the ground. The invention functions to provide a physical point of reference and visual target for a kicker to establish consistent kicking skills and achieve predictable angles. The apparatus is angled outwardly from a sturdy base, and is easily and reversibly disassembled and reassembled, portable, and stored within a durable, packable kit engineered to organize the required training gear, including but not limited to balls, tees, device anchors, recording implements, and audible equipment. The kit comprises at least a carry bag with various pockets for the parts of the kit; one or more balls; the apparatus; a recording tablet (paper or electronic); measuring tape or line; and a kicking tee or holder. Other components of the kit can include an air pump, spare measuring tape, cleat cleaning apparatus, and other related equipment This invention further comprises the method of using the apparatus of the invention to provide lift accuracy in various training drills, practice and competitive environments. The method includes a series of steps whereby the apparatus is assembled; distance from the apparatus is measured; a kicker stands at the measured distance in front of the assembled apparatus and kicks the ball; if the angle of the kick is sufficient to lift the ball over the apparatus it will go over the visual target, if it is insufficient it will fall under the visual target. Generally, this angle would be in the range of forty-two to forty-five degrees relative to the ground.

It is an object of the invention to provide a physical and visual trajectory target for football and related sport training that is sturdy enough to be capable of sustaining impact without moving and is weather-resistant, separable into parts for portability and storage, and easy to assemble on the field.

It is a separate object of this invention to provide a method of using the apparatus of the invention to optimize kicking trajectories of variously sized players at different locations relative to and distances from a field goal or other type of scoring position (spatial element).

It is a further object of this invention to provide a complete and portable kit comprising the equipment needed to teach, learn or practice proper kicking form to achieve desired lift trajectory, including but not limited to the apparatus of the invention, one or more balls, air pumps, measuring devices, ball tees, and other equipment desired for kick training.

REFERENCE CHARACTERS USED IN THE DRAWINGS

1 Base tube
5 Snap button
8 Snap button aperture
10 Extension tube
20 Tube hub
25 Connector tube LC
30 Elbow fitting
35 Cord
40 Cord support
45 Cord aperture
50 measuring strip (attached to bottom brace tube)
55 Carry bag

DETAILED DESCRIPTION

While various embodiments are described herein, it should be appreciated that the present invention comprises many inventive concepts that may be embodied in a wide variety of contexts. Illustrative embodiments of the invention are described below. Not all features of an actual implementation for all embodiments are necessarily described in this specification. In the development of any such actual embodiment implementation, specific decisions may be made to achieve the design-specific goals, which may vary from one implementation to another. It will be appreciated that such a development effort would be a routine undertaking for persons of ordinary skill in the art having the benefit of this disclosure.

The attached drawing figures form part of the present specification and are included to further demonstrate certain aspects of the present claimed subject matter and should not be used to limit or define it. The present subject matter may be better understood by reference to one or more of these drawings in combination with the description of embodiments presented herein.

The disclosed apparatus, method and kit are portable, and provide for assembly and use of the apparatus in a plurality of configurations. More specifically, the different configurations use interchangeable parts, allowing users to assemble the parts of the apparatus into at least two separate embodiments of the invention. These different embodiments are necessary, as the various configurations position the apparatus into different sizes and relative angles for different field locations, player size and experience levels, and also to accommodate various drills and training exercises and drills.

Figure 1:
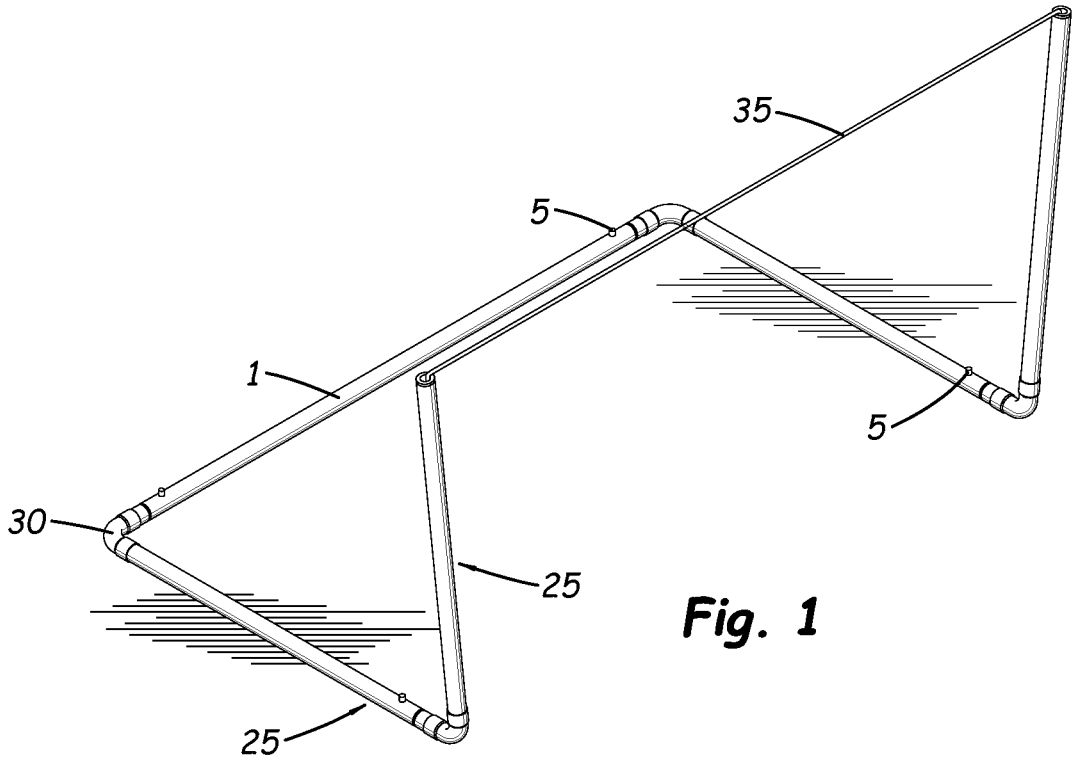
FIG. 1 is a perspective drawing of an embodiment of the invention configured as a low target.

In FIG. 1, a first embodiment of the assembled device is depicted. Not all of the pieces in the kit are required for each embodiment, and certain of the parts are interchangeable and used in multiple embodiments of the apparatus. In the perspective view of the embodiment shown in FIG. 1, a low target is shown. In this embodiment, a base tube 1 with at least a first end and a second end is connected at each of said ends to a connector tube 25 which further comprises one or more elbow fittings 30. One or both of the ends of the base tube 1 and the connector tubes 25 may be swedged (narrowed in diameter as an end of the tube is approached) on one or more ends. Snap buttons 5 on the connector tube 27 conform to a plurality of apertures in the base tube 1; the connector tube 25 releasably connects with the base tube 1 when inserted; one or more snap buttons 5 enter one or more snap button apertures 8. The connector tube 25 is released by applying pressure on the snap button 5 while pulling the tubes apart, which allows the depressed snap button 5 to disengage from the snap button aperture 8 (not depicted in this figure). One skilled in the art would recognize that other methods of connecting the tubes could work to releasably attach the tubes of the invention and remain within the scope of this disclosure.

When assembled in this embodiment, the base tube 1 extends horizontally along the ground. A first pair of connector tubes 25 are attached to the ends of the base tube 1 and positioned coplanar with and generally perpendicular along the ground with the base tube 1. A second pair of connector tubes 25 are attached to the first pair at a right or slightly obtuse angle relative to the ground such that they are upright, and the top of the apparatus and therefore the cord 35 is coplanar with or behind the frontmost portion of the second pair of connector tube 25. The sides of this embodiment can be optionally extended with extension tubes 10 (not depicted in this figure). The cord 35 is then positioned between the top ends of the connector tubes 25 or extension tubes 10, and held in place by the cord support, which is inserted into the open top ends of the connector tubes 25 or extension tubes 10. This cord 35 and the sides extending upward from the ground become the target. Appropriate distance from the apparatus is established using a measuring tape or gauge, the measuring strip 40 (not depicted in this figure), that measures the correct location for the ball relative to the device. Once assembled, a ball is positioned at the correct distance from the apparatus using the measuring strip 40, the player visually aligns the top of the apparatus and cord with the goal post or other spatial element (target point) and kicks a ball over it. By repeating this from different positions on the field or with different spatial elements centered between the sides, the player learns proper positioning, visualization and force needed to control kicking trajectory, or height relative to distance, and can accurately kick toward any target.

The configuration of the embodiment in FIG. 1 allows for small or young players to work on kicking trajectories close to the ground, or for focusing on relatively low kicking targets. Because the players are closer to the device than when they use the high target configurations, the base tube 1 is positioned behind the sides and cord 35 of the device so that players won't be in contact with it as they kick. This is not necessary for the high target configurations, which benefit from the stability of a base tube 1 centered underneath the cord 35, because the player is positioned farther from the apparatus when they kick. This configuration allows for small or young players to work on lower kicking trajectories and nearer targets without contact with the base tube 1.

Figure 2A:
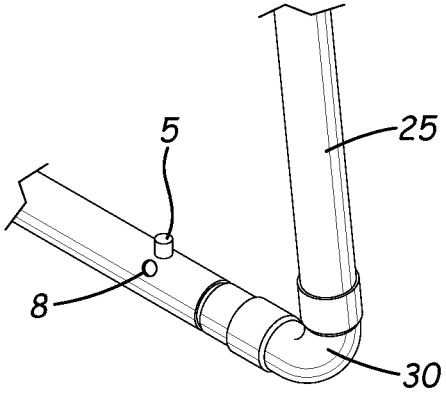
FIG. 2A shows a connector tube of FIG. 2 capable of pivoting to expand the visual target.
Figure 2:
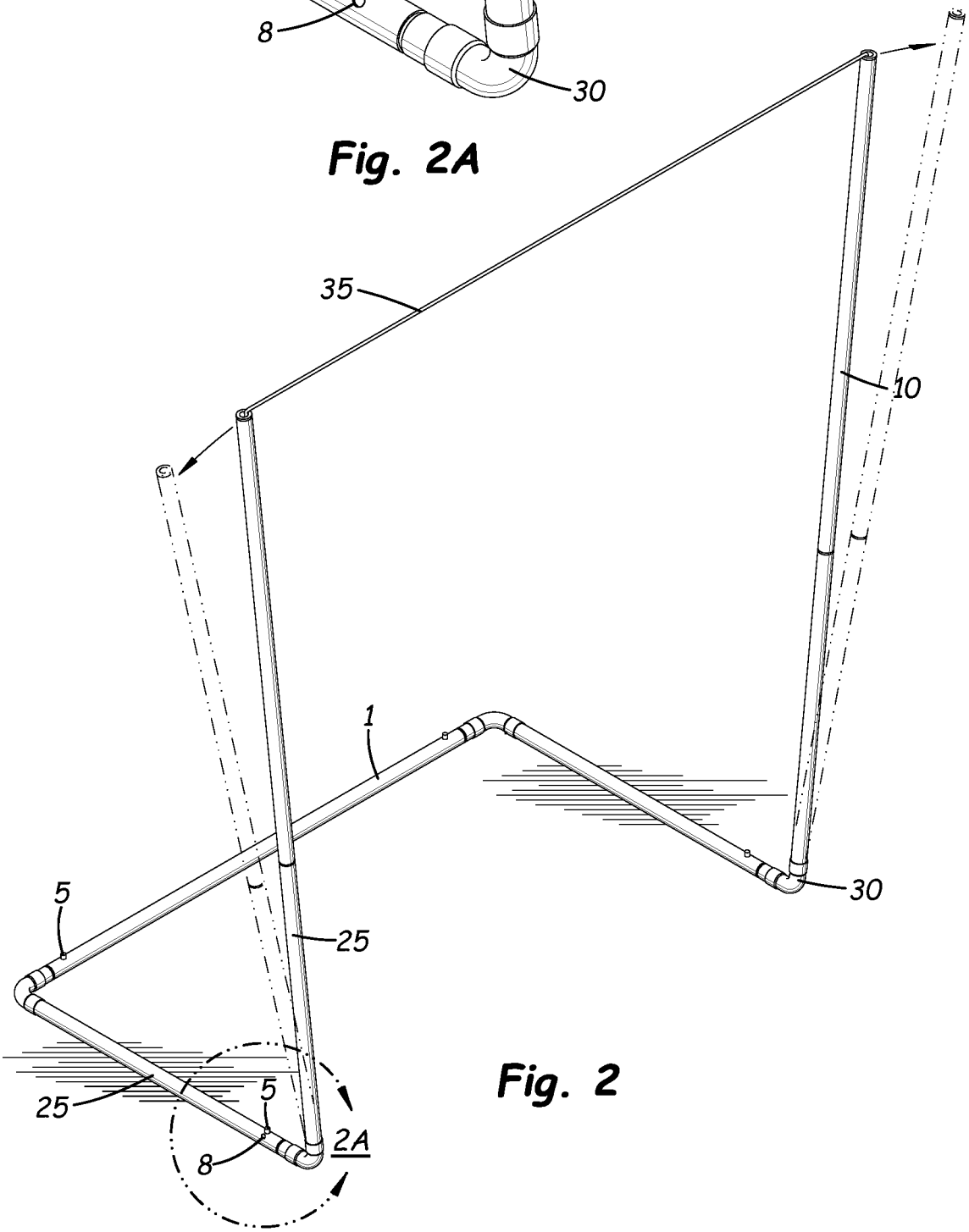
FIG. 2 is a perspective drawing of the embodiment of FIG. 1 with extension tubes extending the low target.

In FIG. 2, the sides of the apparatus are extended using extension tubes 10. The extension tubes 10 may also be swedged and further comprise one or more snap buttons 5 and one or more snap button apertures 8 to attach extension tubes 10 to the connector tubes 25. In this way, the low target can be extended and expanded to include a different, relatively higher low target. In the same way, the high target embodiments shown and described in later figures and their descriptions can be extended and expanded using extension tubes 10.

FIG. 2A shows the connector tube of FIG. 2 capable of pivoting to expand the visual target. Snap button apertures 8 placed around a first connector tube at various positions 25 allow for the insertion of the snap button 5 on a second connector tube at these various positions in order to extend the distance between the top of the connector tubes 25 or their connected extension tubes 10. The cord support 40 is slidably moved to accommodate the greater distance between the tops of the connector tubes 25 or their connected extension tubes 10, and placed inside the top of the connector tubes 25 or their connected extension tubes 10. By extending the span of the cord, the device can be used closer to or farther from a desired goal post or other spatial element. A closer target would have a shorter cord 35 span.

The targets of embodiments shown in FIGS. 1 and 2 can be optionally adjusted by changing the angularity of the sides relative to the base tube 1 and the ground. FIG. 2A illustrates how angularity can be changed by placing apertures and corresponding snap buttons 5 at different locations around the connector tubes 25 attached to the base tube 1. The connector tubes 25 can therefore be rotated outward relative to the center of the device to increase the visual target, or inward to decrease it.

Figure 3:
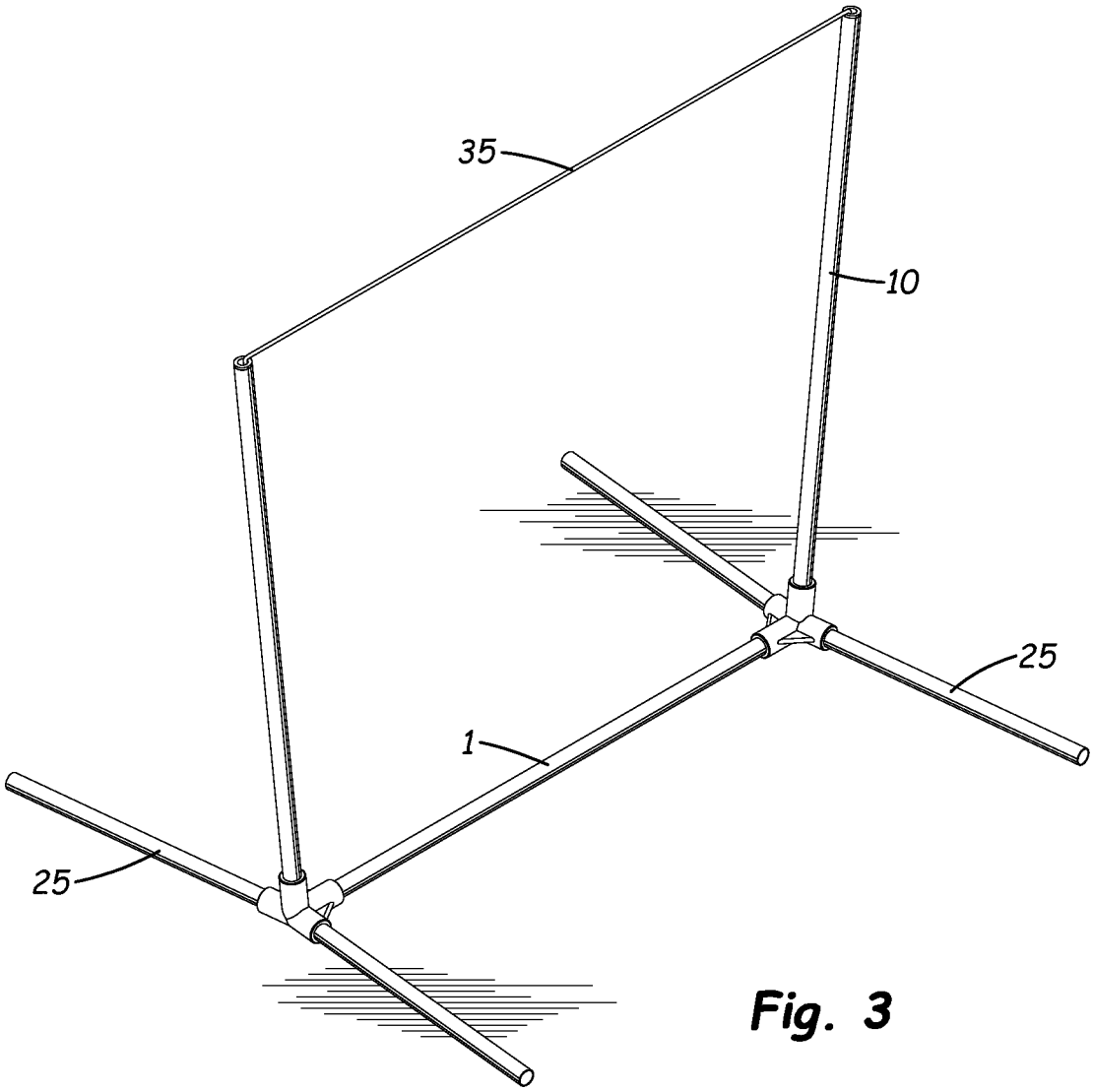
FIG. 3 is a perspective drawing of an embodiment of the invention configured as a high target.
Figure 3A:
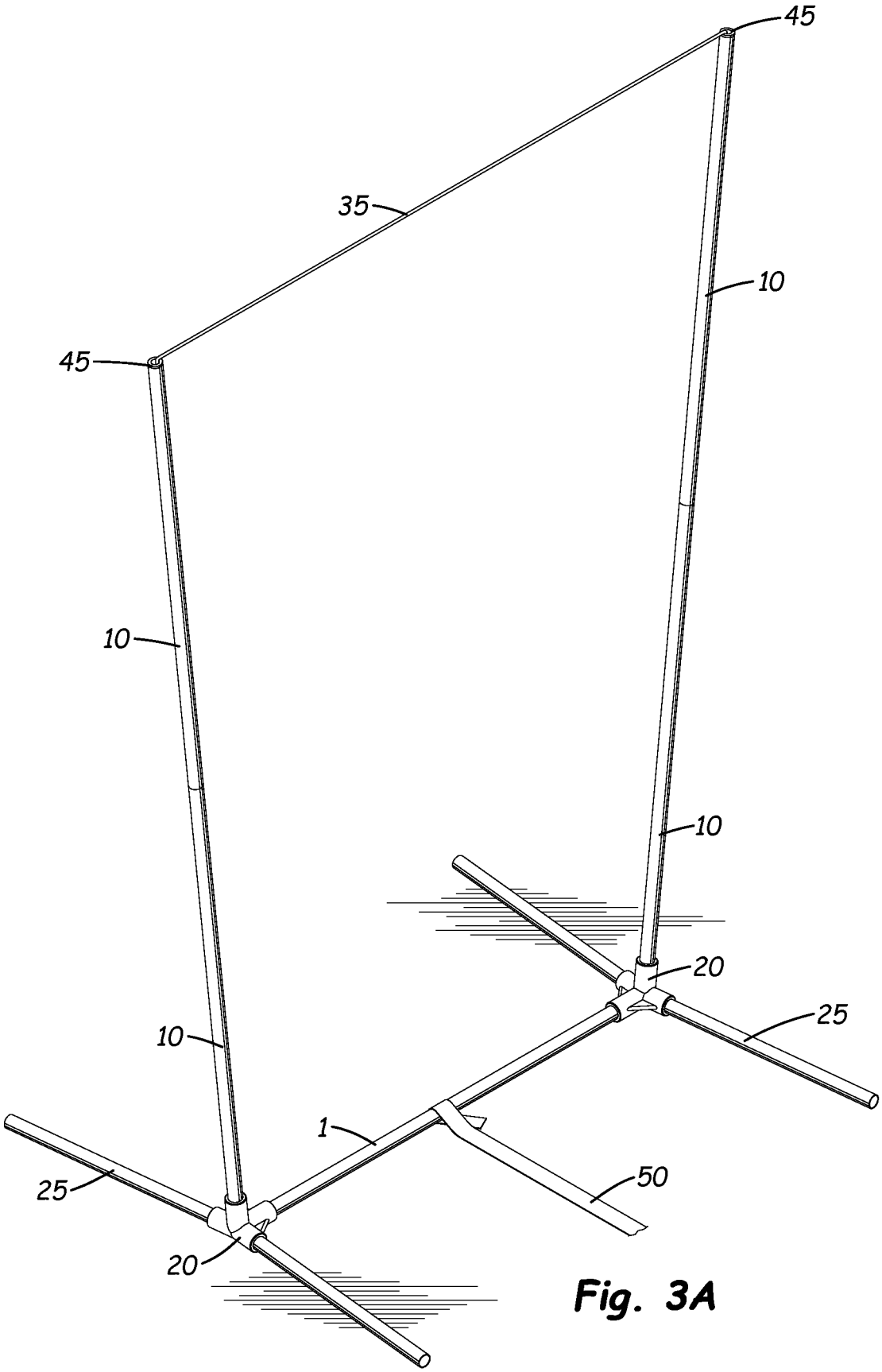
FIG. 3A is a perspective drawing of the embodiment of the apparatus shown in FIG. 3 configured with extension tubes extending the high target.

FIG. 3 is a perspective drawing of an embodiment of the invention configured as a high target. In this embodiment, the base tube 1 connects with extension tubes 10 via a tube hub 20 instead of elbow fittings. The connector tubes 25 in this embodiment may be permanently fastened, continuous with or removeably attached to the tube hub 20, which further comprises apertures for the base tube 1 and connector tubes 25 to position them along the ground to support the device, and extension tubes 10 extending upward. Similar to the embodiment shown in the previous figures, the cord 35 extends between the tops of the extension tubes 10 and is held in place at each end by cord supports 40 positioned within the extension tubes 10 and supported therein. FIG. 3A depicts the extended high target; extension tubes 10 extend the length of the sides of the device and therefore increase the dimensions of the visual target. FIG. 3A also shows the measuring strip 50, which is releasably attachable to the apparatus. Attachment can be accomplished by a number of ways, including snaps, Velcro, slot and button, ties, or flexible bands. The measuring strip 50 is marked with indicia to show distance from the base tube 1; the measuring strip 50 is further comprised of a flexible, foldable or rollable and water and weather resistant material.

The configurations shown in FIG. 1 and FIG. 3 can be assembled and used simultaneously with the parts in the kit.

Figure 4:
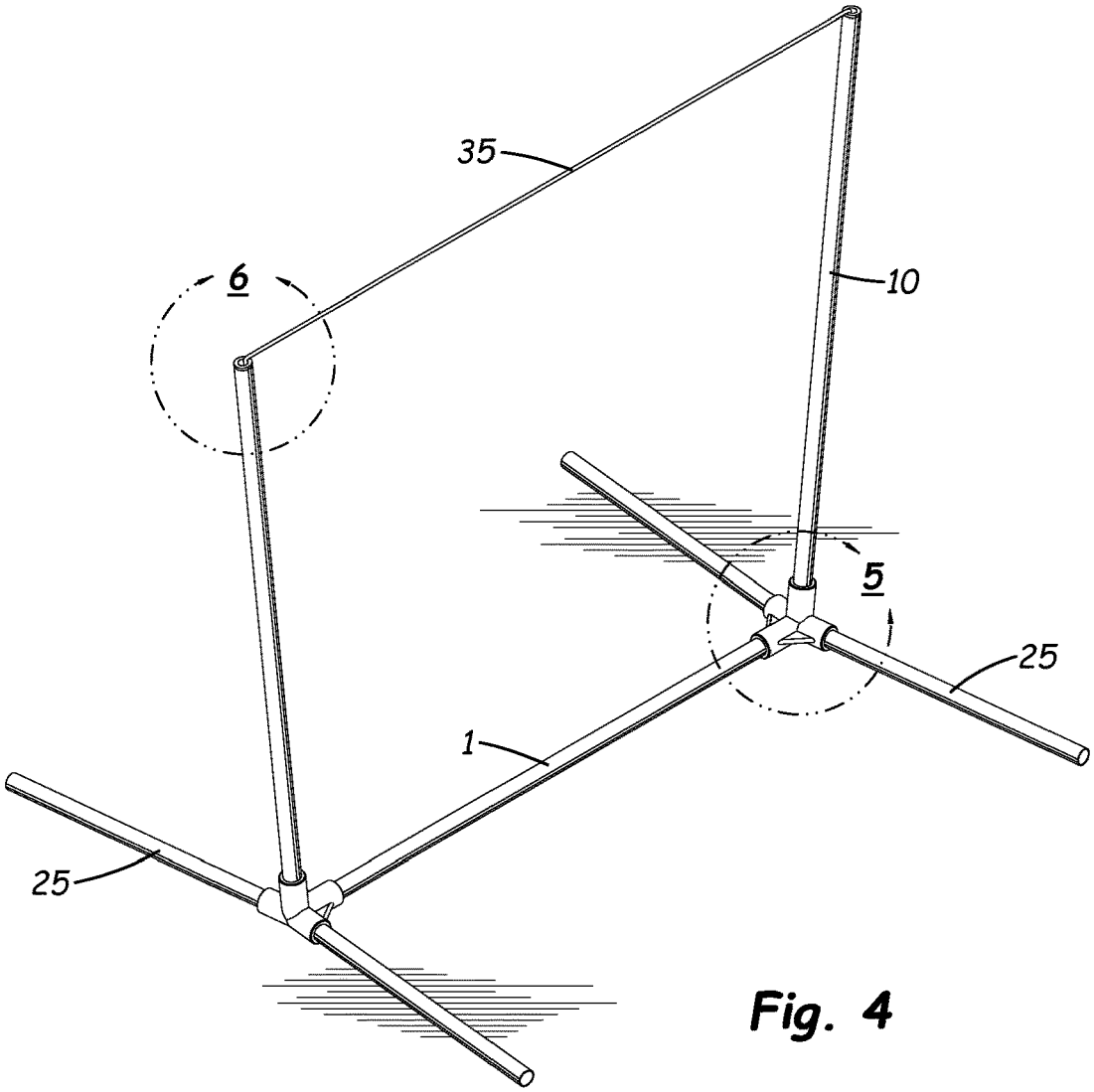
FIG. 4 is a perspective drawing of the embodiment of FIG. 3 with the tube connector hub and cord aperture areas, as drawn in FIG. 5 and FIG. 6 respectively, shown in the dot-dot-dash circles.
Figure 5:
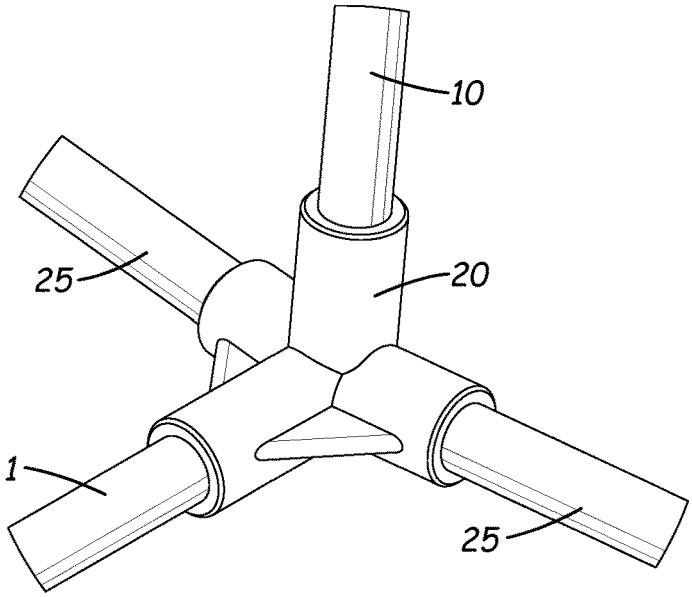
FIG. 5 is an expanded drawing of a tube connector hub.
Figure 6:
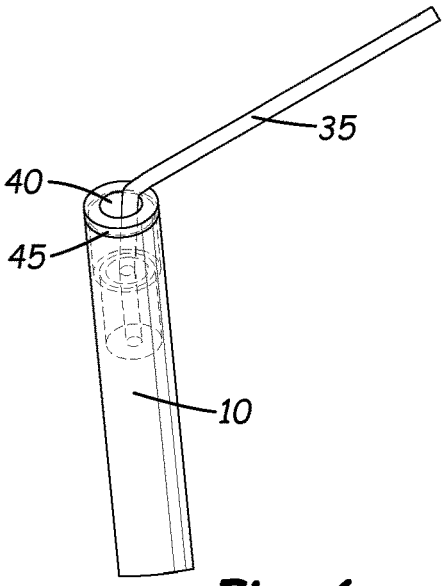
FIG. 6 is an expanded drawing of a cord aperture and cord positioned within it.

In FIG. 4, a perspective drawing of the embodiment of FIG. 3 is shown, with the tube hub 20 and cord aperture 45 areas, as drawn in FIG. 5 and FIG. 6 respectively, shown in the dot-dot-dash circles. In one embodiment, the top of the extension tube 10 is notched to further support the cord 35 and cord support 40. In a preferred embodiment, the one or more base tubes 1, two or more connector tubes 25 and two or more extension tubes 10 are durable, water and weather resistant and hollow, and further comprise apertures on each end capable of insertion by other connector tubes 25 and extension tubes 10.

FIG. 5 is a blow-up drawing of a tube hub 20. The tube hub 20 has apertures that support, matingly conform to and are capable of being inserted by the base tube 1, connector tubes 25 and extension tubes 10. Connector tubes 25 extend from the tube hub 20 generally coplanar with the base tube 1 and are assembled such that they run along the ground, extending outward to support the apparatus. They may be permanently affixed to the tube hub 20, or swedged and removeably inserted into the apertures of the tube hub 20. Similarly, the extension tubes 10 conform to the apertures of the tube hub 20; they extend upwards from the tube hub 20, and hold and position the cord 35 across the top of the apparatus and between them.

FIG. 6 is an expanded drawing of a cord aperture 45 and cord 35 positioned within it. The cord support 40 is positionable and slidably attached to the cord 35, and is inserted into the top of the extension tube 10, which may or may not be notched to support the cord 35. The cord support 40 is capable of sliding and securing the cord 35 within the cord aperture 45. In the low target embodiment of this invention, the cord 35 and cord support 40 can either be positioned within the connector tube 25 or the extension tube 10.

Figure 7:
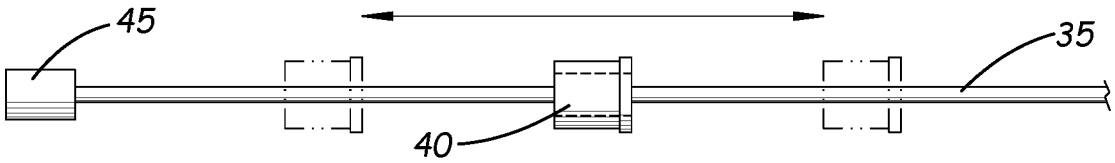
FIG. 7 is a drawing showing the cord and positionable cord support capable of sliding and securing the cord within the cord aperture.

FIG. 7 is a drawing showing the cord 35 and positionable cord support 40 capable of sliding and securing the cord 35 within the cord aperture 45. The cord 35 is positioned within the cord support 40 and slideably connects with it. Each cord support 40 is capable of removeable insertion into an aperture at an end of an extension tube 10 or an end of a connector tube 25. In a preferred embodiment, a plurality of differently colored and different length cords 35 are provided with the apparatus; the different colors are used to easily distinguish them from one another. The various lengths allow for identification and expansion of the target to include training or practice at different kicking angles.

Figure 8:
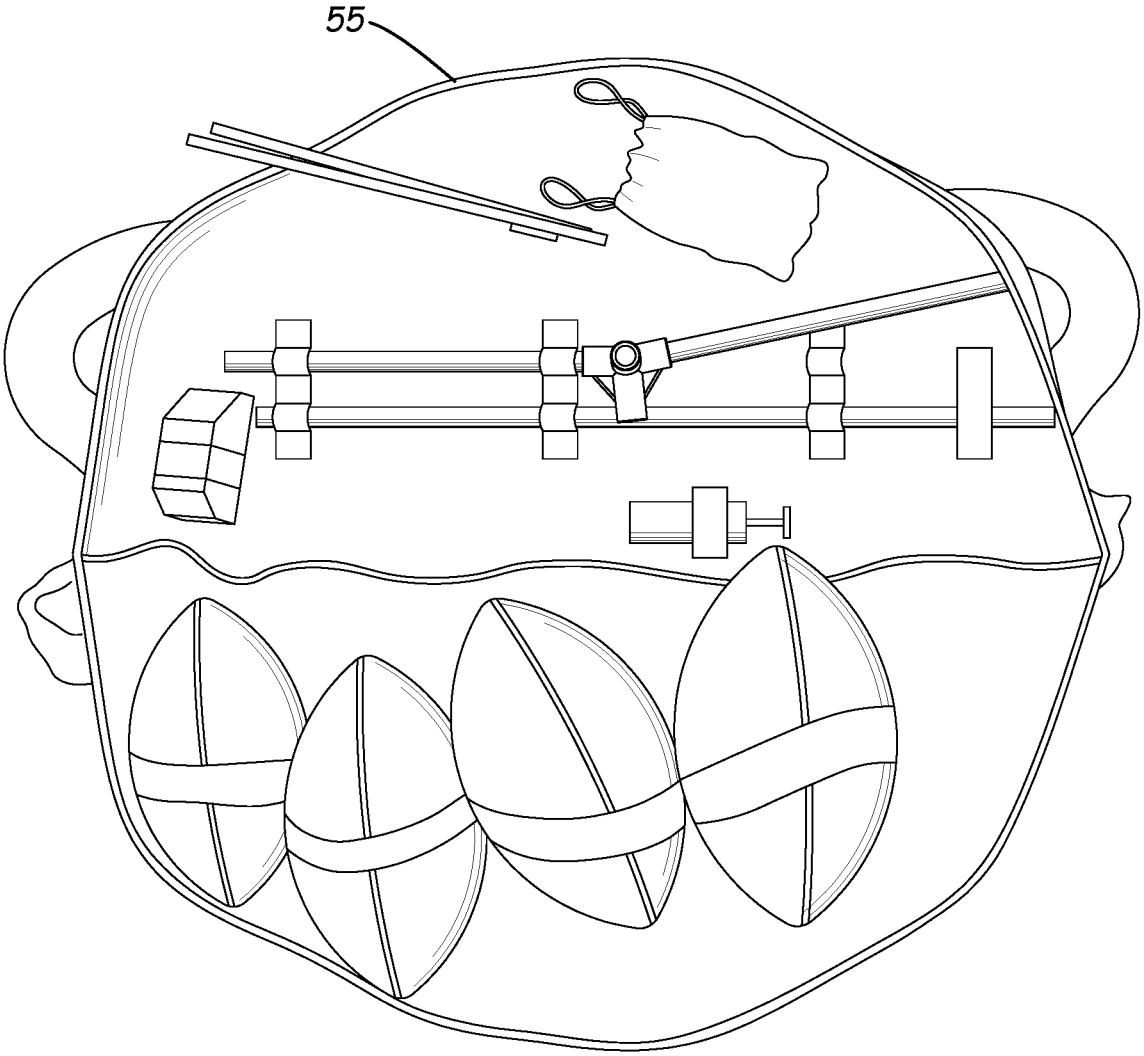
FIG. 8 shows the kit of the invention, including various components attached to or positioned within the carry bag.

In FIG. 8, an embodiment of the kit of the invention is shown. In a preferred embodiment, the kit comprises at least a carry bag 55 with elastic fasteners and pockets capable of securing and positioning the various parts of the kit; the apparatus of the invention; one or more balls; kicking tees or ball placement devices; and a recording tablet. The recording tablet may be paper, coated cardboard, electronic, or any other medium suitable for noting and recording player performance and training data. It should be appreciated by one skilled in the art that other components for enhancing training, such as markers, training manuals, sound devices such as whistles, lights, towels, electronic calculators, or a host of other training and exercise tools could be included and still fall within this disclosure.

This invention further comprises the method of using the invention to provide kick training and lift skill development in various field, competitive and training environments. The method of the invention comprises the following steps; the sequence of these steps may be varied and still remain within the scope of this disclosure. The steps are basically the same for use of the invention as a low target or a high target, with the difference primarily being the way the base tube 1 connects with the upright sides of the invention. The low target uses elbow fittings 30 to connect the base tube 1 to the connector tubes 25 so that the base tube 1 is behind the plane of the cord 35, keeping it away from the player's feet, and the high target uses a tube hub 20 which positions the cord 35 above the base tube 1 for increased stability of the high target.

The following steps allow the kit to be used as a low target: First, the parts of the kit are removed from the carry bag containing the parts of the invention. The base tube 1 is attached to or connected with a first pair of connector tubes 25 by attaching them to the ends of the base tube 1 and positioning the first pair of connector tubes 25 coplanar with and generally perpendicular along the ground with the base tube 1. A second pair of connector tubes 25 is connected by attaching them to or with elbow fittings 30 to the first pair of connector tubes 25 at a right or slightly obtuse angles relative to the ground such that they are upright and the top of the apparatus and therefore the cord 35 is coplanar with or behind the frontmost portion of the second pair of connector tubes 25. The apparatus can be optionally extended by increasing the height of the target created by the assembled apparatus by attaching extension tubes 10 to the connector tubes 25. A cord 35 is then positioned by placing two cord supports 40 attached to the cord 1 between the top ends of the connector tubes 25 or extension tubes 10. By sliding a cord support 40 to each of the top ends and inserting the cord supports 40 into said top ends, they maintain the cord 35 in place across the top of the apparatus such that the cord 35 and the tubes extending upward from the ground become a target. The appropriate distance from the apparatus is then measured by extending a removeably attached measuring strip 50 and measuring the correct location for a ball and player relative to the apparatus. Once the apparatus is assembled, the player visually aligns the top of the apparatus and cord 35 with the goal post or other spatial element (target point) and kicks a ball over it. The player then repeats steps (a-g) from different positions on the field or with different spatial elements centered between the sides until the player learns proper positioning, visualization and force needed to control kicking trajectory and can accurately kick toward any target. When practice or play is finished, the apparatus is disassembled by separating all of the attached parts; the parts of the apparatus are returned to and attached inside the carry bag for portability and storage.

The following steps allow the kit to be used as a high target: First, the parts of the kit are removed from the carry bag 55 containing the parts of the invention. The base tube 1 is attached to or connected with a first pair of connector tubes 25 by attaching the base tube 1 to a tube hub 20 such that the first pair of connector tubes 25 is attached to the tube hub 20 positioning the first pair of connector tubes 25 coplanar with and generally perpendicular along the ground with the base tube. 1. A second pair of connector tubes 25 or a first pair of extension tubes 10 is connected by attaching them to or with the tube hub 20 such that they are upright and the top of the apparatus and therefore the cord 35 is positioned parallel to the base tube 1. The apparatus can be optionally extended, increasing the height of the target created by the assembled apparatus by attaching extension tubes 10 to the connector tubes 25. A cord 35 is then positioned by placing two cord supports 40 attached to the cord 35 between the top ends of the connector tubes 25 or extension tubes 10. By sliding a cord support 40 to each of the top ends and inserting the cord supports 40 into said top ends, they maintain the cord 35 in place across the top of the apparatus such that the cord 35 and the tubes extending upward from the ground become a target. The appropriate distance from the apparatus is then measured by extending a removeably attached measuring strip 50 and measuring the correct location for a ball and player relative to the apparatus. Once the apparatus is assembled, the player visually aligns the top of the apparatus and cord 35 with the goal post or other spatial element (target point) and kicks a ball over it. The player then repeats steps (a-g) from different positions on the field or with different spatial elements centered between the sides until the player learns proper positioning, visualization and force needed to control kicking trajectory and can accurately kick toward any target. When practice or play is finished, the apparatus is disassembled by separating all of the attached parts; the parts of the apparatus are returned to and attached inside the carry bag 55 for portability and storage.

I claim:

1. A portable football kick training apparatus, comprising: one or more base tubes, two or more connector tubes and two or more extension tubes; four or more elbow fittings; a plurality of cords with at least two cord supports for each cord, wherein each of the plurality of cords is a different color and length, and is positioned within and slidably connected with the cord supports; and wherein the cord supports are each capable of removeable insertion into an end of an extension tube or an end of a connector tube; and a releasably attachable measuring strip.

2. The apparatus of claim 1 wherein the apparatus is capable of assembly into a plurality of configurations such that the various configurations position the apparatus into different sizes and relative angles for different field locations, player size and experience levels.

3. The apparatus of claim 1 wherein the connector tubes and extension tubes are interchangeable such that the apparatus can be configured into at least a low target, an extended low target, a high target and an extended high target.

4. The apparatus of claim 1 wherein the one or more base tubes, two or more connector tubes and two or more extension tubes are durable, water and weather resistant and hollow, and further comprise apertures on each end capable of insertion by other connector tubes and extension tubes.

5. The apparatus of claim 1 wherein one or more ends of the base tubes, connector tubes and extension tubes are swedged such that they can be easily inserted and removeably attached to the ends of other base tubes, connector tubes and extension tubes.

6. The apparatus of claim 1 wherein the one or more base tubes, connector tubes and extension tubes further comprise one or more snap buttons and one or more snap button apertures; and wherein the snap button or buttons of one of the tubes are capable of entry into the snap button apertures on another of the tubes to releasably connect the one or more base tubes, connector tubes and extension tubes.

7. The apparatus of claim 6 wherein the snap button apertures are positioned around the connector tubes such that the connector tubes can be rotated outward relative to a center of the apparatus when the apparatus is assembled to increase a visual target, or inward to decrease the visual target.

8. The apparatus of claim 1 wherein the connector tubes and extension tubes are notched at one end to accommodate and support one of the cords when the apparatus is assembled.

9. The apparatus of claim 1 wherein the elbow fittings are continuous with or permanently attached to the connector tubes.

10. The apparatus of claim 1 wherein the elbow fittings are separate but capable of coupling the one or more base tubes with a connector tube or an extension tube.

11. The apparatus of claim 1 wherein the measuring strip is marked with indicia to show distance from the base tube; the measuring strip is further comprised of a flexible, foldable or rollable and water and weather resistant material.

12. The apparatus of claim 1 wherein a low target and a high target can be simultaneously assembled and used.

13. A football kick training kit comprising a carry bag with elastic fasteners and pockets; the apparatus of claim 1; one or more balls; one or more kicking tees or ball placement devices; and a recording tablet.

14. A method of using the football kick training apparatus and kit of claim 13, comprising the steps of:

a) removing the apparatus from the carry bag;

b) assembling the apparatus as a low target by releasably connecting one of the base tubes with a first pair of the connector tubes by attaching them to the ends of the base tube and positioning the first pair of connector tubes coplanar with and generally perpendicular along the ground with the base tube;

c) releasably connecting a second pair of the connector tubes by attaching them to or with elbow fittings to the first pair of connector tubes at right or slightly obtuse angles relative to the ground such that the second pair of the connector tubes is upright and a topmost portion of the apparatus is coplanar with or behind a frontmost portion of the second pair of connector tubes;

d) optionally extending the height of the low target created by the assembled apparatus by attaching a first pair of the extension tubes to the second pair of the connector tubes;

e) positioning a cord and two attached cord supports between top ends of the second pair of the connector tubes or the first pair of the extension tubes by sliding one of the cord supports along the cord to each of the top ends and inserting the cord supports into said top ends, thereby maintaining the cord in place across the topmost portion of the apparatus such that the cord and the tubes extending upward from the ground become the low target;

f) measuring an appropriate distance from the apparatus by extending the removeably attached measuring strip and measuring a correct location for a ball and player relative to the apparatus;

g) once the apparatus is assembled, the player visually aligns the topmost portion of the apparatus and cord with a goal post or other spatial element forming a target portion and kicks a ball over the target point;

h) repeating at least steps (f) and (g) from different positions on a field or with different spatial elements centered between the second pair of the connector tubes or the first pair of the extension tubes until the player learns proper positioning, visualization and force needed to control kicking trajectory and can accurately kick toward any target;

i) disassembling the apparatus; and j) returning the apparatus to the carry bag for portability and storage.

15. The method of claim 14, comprising the steps of:

a) removing the apparatus from the carry bag;

b) assembling the apparatus as a high target by releasably connecting one of the base tubes with one of a pair of tube hubs on either end;

c) releasably connecting a first pair of the connector tubes to one of the tube hubs such that the first pair of connector tubes is attached to the tube hub positioning the first pair of connector tubes coplanar with and generally perpendicular along the ground with the base tube;

d) releasably connecting a second pair of the connector tubes or a first pair of the extension tubes by attaching them to or with the tube hubs such that the second pair of the connector tubes or the first pair of the extension tubes are upright and the topmost portion of the apparatus is positioned parallel to the base tube;

e) optionally extending the height of the high target created by the assembled apparatus by attaching a second pair of the extension tubes to the second pair of the connector tubes or the first pair of the extension tubes;

f) positioning one of the cords and two attached cord supports between top ends of the second pair of the connector tubes or the first or second pair of the extension tubes by sliding one of the cord supports to each of the top ends and inserting the cord supports into said top ends, thereby maintaining the cord in place across the topmost portion of the apparatus such that the cord and the tubes extending upward from the ground become the high target;

g) measuring the appropriate distance from the apparatus by extending the removeably attached measuring strip and measuring the correct location for a ball and player relative to the apparatus;

h) once the apparatus is assembled, the player visually aligns the topmost portion of the apparatus and cord with a goal post or other spatial element forming a target point and kicks a ball over the target point;

i) repeating at least steps (g) and (h) from different positions on the field or with different spatial elements centered between the second pair of the connector tubes or the first or second pair of the extension tubes until the player learns proper positioning, visualization and force needed to control kicking trajectory and can accurately kick toward any target;

j) disassembling the apparatus; and k) returning the apparatus to the carry bag for portability and storage.

* * * * *